US011009276B1

(12) United States Patent
Clark

(10) Patent No.: US 11,009,276 B1
(45) Date of Patent: May 18, 2021

(54) APPARATUS FOR FORMING BLOCKS OF COMPACTABLE MATERIAL

(71) Applicant: Christopher K. Clark, Flint, TX (US)

(72) Inventor: Christopher K. Clark, Flint, TX (US)

( * ) Notice: Subject to any disclaimer, the term of this patent is extended or adjusted under 35 U.S.C. 154(b) by 0 days.

(21) Appl. No.: 16/894,839

(22) Filed: Jun. 7, 2020

(51) Int. Cl.
*F25C 5/14* (2006.01)
*B30B 11/02* (2006.01)
*B28B 3/02* (2006.01)

(52) U.S. Cl.
CPC ..... *F25C 5/14* (2013.01); *B30B 11/02* (2013.01); *B28B 3/02* (2013.01); *B30B 11/025* (2013.01)

(58) Field of Classification Search
CPC ..... B30B 11/02; B30B 11/025; B30B 11/04; B30B 11/06; B44C 3/04; B44C 5/00; F25C 5/14; A63H 33/32; Y10S 425/057; B28B 3/02; B28B 3/021; B28B 3/027; B28B 3/028; B28B 3/04; B28B 3/086
USPC ..... 249/66.1, 74, 75, 76
See application file for complete search history.

(56) References Cited

U.S. PATENT DOCUMENTS 2,752,631 A * 7/1956 Wendt ..... E01H 5/02 425/181
3,816,048 A 6/1974 Berry
3,848,846 A 11/1974 Ebner
3,859,029 A 1/1975 Kammer
4,153,404 A * 5/1979 Ottman ..... B30B 9/301 425/256
4,154,423 A 5/1979 Crock
4,745,763 A * 5/1988 Tsukada ..... F25C 5/14 62/66
8,882,489 B1 * 11/2014 Coomer ..... F25C 5/14 425/407
9,474,986 B2 10/2016 Drylie
9,694,297 B2 7/2017 McMahon
9,738,048 B2 * 8/2017 Hediger ..... B30B 15/026
2008/0289356 A1 * 11/2008 Park ..... F25C 5/14 62/345
2008/0307680 A1 12/2008 Schlichting
2010/0230842 A1 9/2010 Pendergast
2015/0151211 A1 * 6/2015 Drylie ..... A63H 33/001 446/85
2015/0367536 A1 * 12/2015 Compton ..... B29C 33/0055 425/218
2016/0303817 A1 * 10/2016 Hediger ..... B30B 15/026
2019/0353415 A1 * 11/2019 Henderson ..... F25C 1/25

* cited by examiner

*Primary Examiner* — Seyed Masoud Malekzadeh

(57) ABSTRACT

Apparatuses for forming blocks of compactable material such as snow, having a hollow upper body with a compression chamber within for containing and subsequently compressing the compactable material to form a block that can be used in connection with recreational activities. A lower body having a flat compression plate attached to a top end, is configured to slide within the compression chamber, the compression plate being capable of pushing the compactable material into a hinged lid that is attached to a top end of the upper body and acts to cover a top opening of the upper body. Ferromagnetic materials attached to the underside of the compression plate are configured to contact other ferromagnetic materials attached to the interior walls of the compression chamber, which at least temporarily arrests sliding movement of the upper and lower bodies, and allows a user to fill the apparatus with compactable material.

19 Claims, 9 Drawing Sheets

APPARATUS FOR FORMING BLOCKS OF COMPACTABLE MATERIAL

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Technical Field

The present invention relates generally to apparatuses for forming materials into shapes, and more specifically, to apparatuses for forming blocks of compactable material such as snow, which adults and children may use in connection with winter recreational activities such as making snow forts.

Description of Related Art

Each year, numerous children and adults engage in wintertime recreational activities that involve playing with and otherwise using snow. Such recreational activities often include using snow to build temporary structures such as snow forts and igloos. In order to construct such structures made from snow, it is desirable to be able to form snow into compact blocks or bricks. Snow in a compacted block form is generally more dense than naturally occurring snow, making such blocks more structurally rigid and capable of more readily withstanding various forces experienced by such blocks when used as part of structure such as a snow fort. While prior art snow brick making apparatuses exist, such apparatuses generally suffer from various drawbacks to their construction and/or operation of use. In the case of some such prior art snow brick making apparatuses, the designs are unnecessarily complicated, requiring numerous components and taking up excessive space. In the case of other such prior art snow brick making apparatuses, the designs are not amenable to making numerous snow blocks in a short period of time. In the case of other such prior art snow brick making apparatuses, they are not easily used by both adults and children.

Accordingly, what is needed is an apparatus for forming blocks of compactable material having relatively few complex components such that the apparatus can be easily manufactured, easily repaired if necessary, and occupies a minimal amount of space. What is also needed is an apparatus than can be used to efficiently and quickly form multiple blocks of compactable material in a short period of time. What is further needed is an apparatus having operating steps that can be easily learned and performed by adults and children alike. These and other needs are met by the embodiments of the apparatus for forming blocks of compactable material described below with reference to the accompanying drawings.

BRIEF DESCRIPTION OF THE SEVERAL VIEWS OF THE DRAWINGS

The invention will be more fully understood by reference to the following detailed description of the preferred and alternate embodiments when read in conjunction with the accompanying drawings, wherein.

Figure 1:
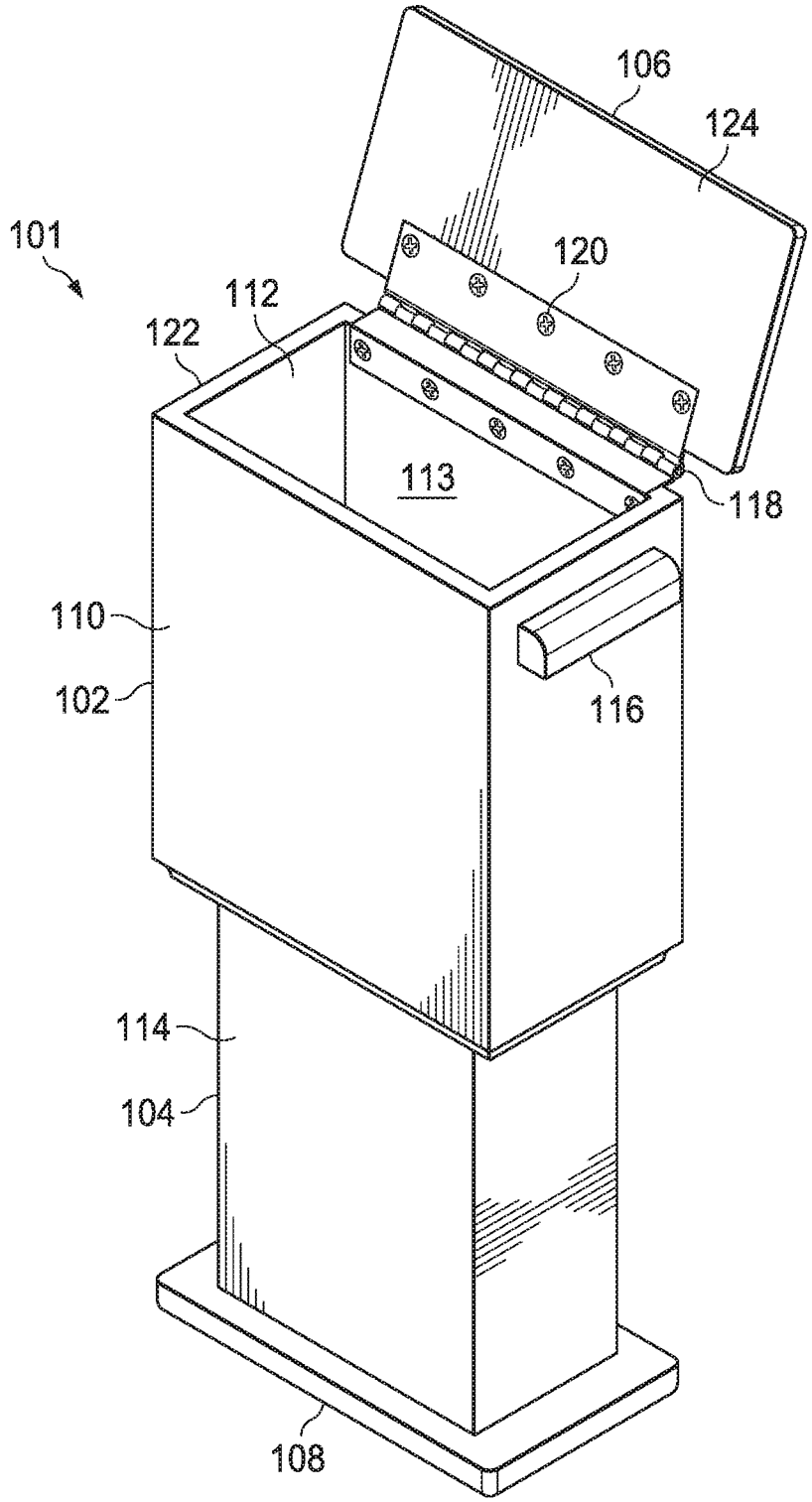
FIG. 1 is an upper perspective view of an embodiment of an apparatus for forming blocks of compactable material shown in a raised configuration of operation.

The above figures are provided for the purpose of illustration and description only, and are not intended to define the limits of the disclosed invention. Use of the same reference number in multiple figures is intended to designate the same or similar parts. Furthermore, if and when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION OF EMBODIMENTS OF THE INVENTION

Several exemplary embodiments of the claimed invention(s) will now be described with reference to the drawings. Unless otherwise noted, like elements will be identified by identical numbers throughout all figures. The invention(s) illustratively disclosed herein suitably may be practiced in the absence of any element that is not specifically disclosed herein.

Apparatuses for forming blocks of compactable materials are disclosed herein. It should be noted that while the exemplary embodiments of the inventions as described herein are associated with the forming of bricks or blocks made from snow, the apparatuses taught herein could also be equally utilized in connection with forming and molding other types of bricks and blocks such as, for example, blocks and bricks made of compacted sand. Indeed, it is contemplated that the inventions taught herein could be utilized in connection with the forming of all manner of bricks and blocks composed primarily of compactable materials.

Figure 2:
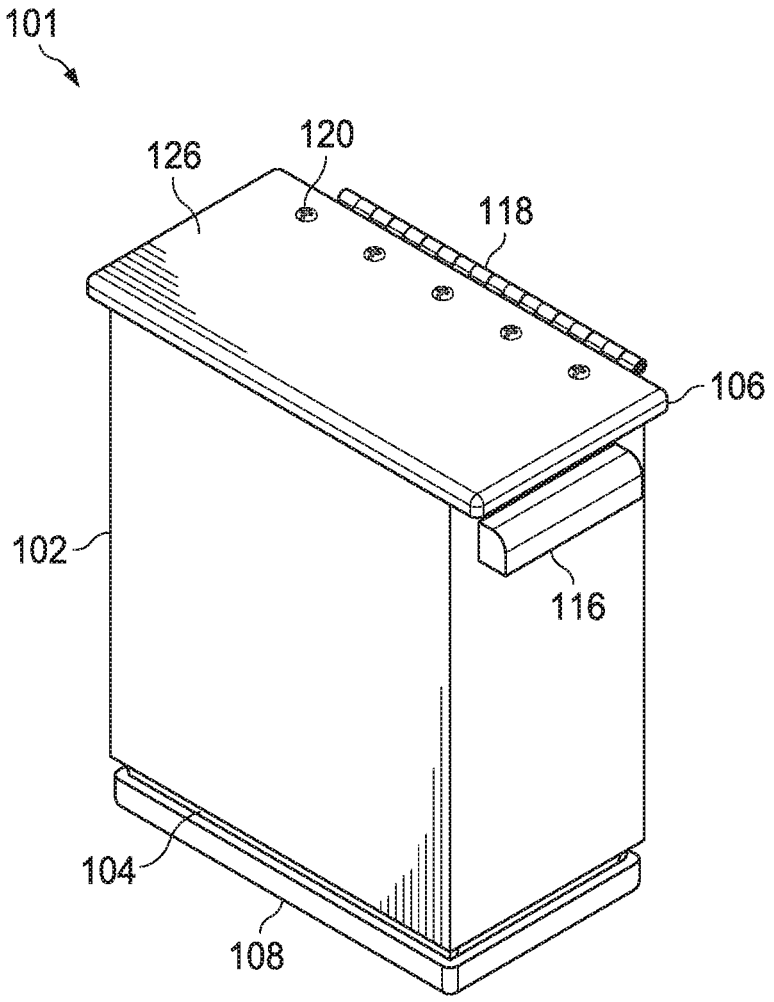
FIG. 2 is an upper perspective view of the embodiment of the apparatus for forming blocks of compactable material as depicted in FIG. 1, shown in a lowered configuration of operation.

Referring now to FIG. 1, an upper perspective view of an embodiment of the apparatus for forming blocks of compactable material in a raised configuration of operation is shown. In one embodiment, an apparatus for forming blocks of compactable material (101) includes a hollow upper body (102) having interior walls (112) forming a compression chamber (113) for filling with compactable material such as snow, the compression chamber having a top opening (122) and a bottom opening (not shown in FIG. 1, but see FIG. 3). In one embodiment, the apparatus for forming blocks of compactable materials also includes a lid (106) that is attached to the hollow upper body such that when the lid is in a closed position (as shown in FIG. 2), the lid covers the top opening of the compression chamber. In one embodiment, the apparatus for forming blocks of compactable materials also includes a lower body (104) having a flat upper compression plate (see FIGS. 3-5 at 136) that is formed on a top end of an elongate lower section (114) of the lower body (104) and is configured to nest within said compression chamber formed by the interior walls (112), the upper compression plate having an outer perimeter that is substantially equal to an inside perimeter of the interior walls of the compression chamber, and the upper compression plate and at least a portion of said elongate lower section both being sized to slide within at least a portion of a length of said compression chamber. In one embodiment, the apparatus for forming blocks of compactable materials also includes at least one downwardly facing first ferromagnetic material (such as a permanent magnet or a metal or combination of metals that is attracted to a magnet) (see FIG. 3 at 140) that is attached to an underside section of the upper compression plate that overhangs the elongate lower section of the lower body, and at least one upwardly facing second ferromagnetic material (such as a permanent magnet or a metal or combination of metals that is attracted to a magnet) (see FIG. 3 at 132) that is attached to a shelf that is attached or formed on interior walls and protrudes into the compression chamber of the hollow upper body so as to contact the at least one downwardly facing first ferromagnetic material when the apparatus is in a raised configuration of operation. In some embodiments, including the embodiments shown in FIGS. 3-6, the upwardly facing ferromagnetic material is mounted on or otherwise attached to an elongated shelf (128) (in one embodiment, a rectangularly shaped block structure) that is in turn attached or formed on one or more sides of the interior walls of the upper body of the apparatus. In one embodiment, the apparatus for forming blocks of compactable materials is also configured such that a magnetic attraction exists between at least one downwardly facing first ferromagnetic material and the at least one upwardly facing second ferromagnetic material when the apparatus is in a raised configuration of operation, such that the aforementioned magnetic attraction at least temporarily arrests any sliding of said upper compression plate within said compression chamber (and vice versa, arrests any sliding of the upper body with respect to the lower body and compression plate).

Figure 4:
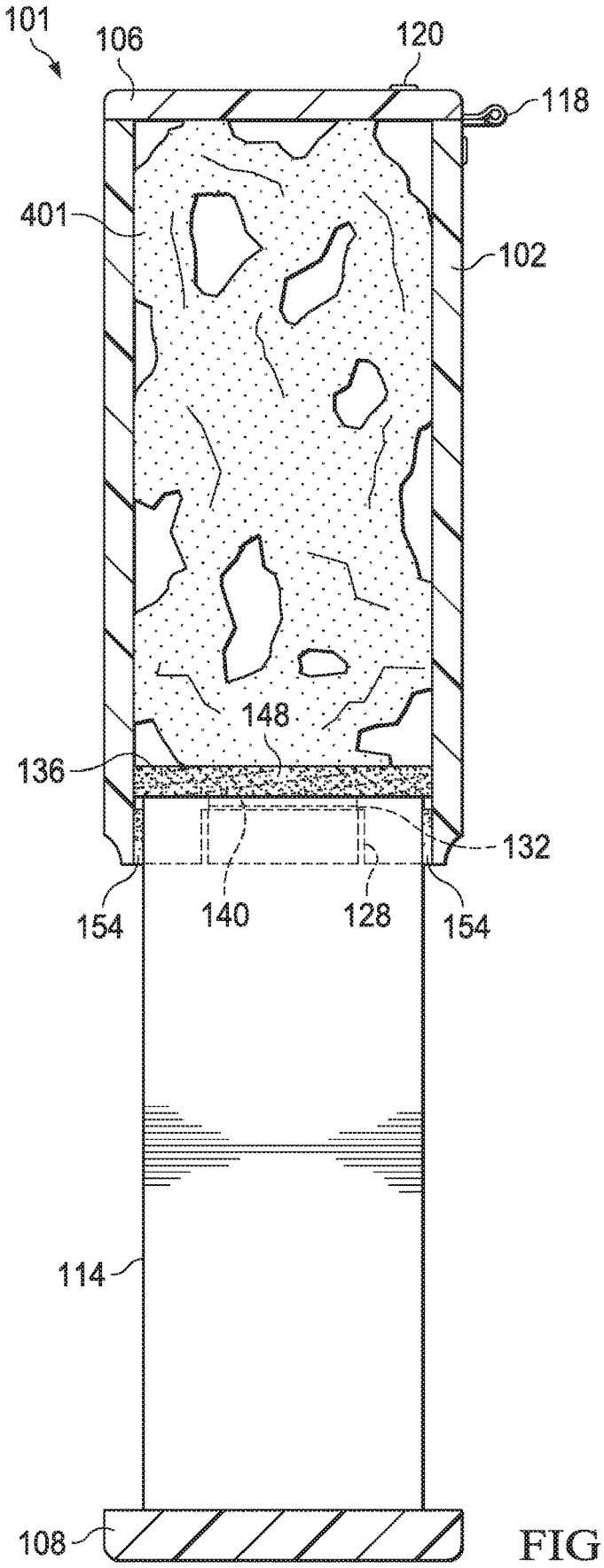
FIG. 4 is a cross-sectional view of the embodiment of the apparatus for forming blocks of compactable material as depicted in FIG. 1, shown in a raised configuration of operation, and having compactable material contained within the compression chamber.

Still referring to FIG. 1, in one embodiment of the apparatus (101) for forming blocks of compactable material, the upper body (102) comprises a box like structure having a front exterior side, back exterior side, and two lateral exterior sides. The upper body is hollow, having interior walls corresponding to the front, back, and lateral exterior sides, said interior walls forming a compression chamber (113). The upper body is not entirely enclosed in that it has a top opening that may be covered by a lid (106), and a bottom opening through which a lower body (104) having a top mounted compression plate (136) mates. As discussed in further detail below, the apparatus is configured such that the upper compression plate may slide upwards and downwards along the length of the compression chamber such that when a compactable material such as snow is inserted into the compression chamber and the lid is closed, a user may cause the upper compression plate to travel in a direction towards the lid (or cause the lid to travel towards the upper compression plate, depending on the perspective), causing the snow to be compacted against the lid, forming the snow into a denser and more structurally rigid block shaped object. In a raised configuration of operation, which is depicted in FIG. 1 and FIG. 4, the upper compression plate is at its maximum distance of travel with respect to the top opening of the upper body (in other words, the greatest distance between the top opening of the upper body and the top of the upper compression plate). The compression chamber in this raised configuration of operation of the apparatus has its maximum available volume in which a user may fill said compression chamber with snow or another compactable material. When a user applies a downwardly directed force on the upper body (for example, via the handles (116)) and/or indentations (758) formed on the lid as depicted in FIG. 7), the upper body will then travel downward, causing the distance between the top of the upper compression plate and the top opening of the upper body to decrease (the upper compression plate appears to slide upwards through at least part of the length of the compression chamber, compacting the snow as it slides). With the lid closed over the top opening of the upper body to cover the compression chamber, and as the compression plate slides towards the top opening (or alternatively, depending on the perspective, as the upper body slides downward with respect to the compression plate and elongate lower section), any compactable material within the compression chamber will be compacted into a block that is the shape of the compression chamber, which in the case of the apparatus of FIG. 1, would be the form of a block or brick (assuming that enough volume of compactable material has been loaded into the compression chamber). At this stage of operation, the apparatus would be in an intermediate configuration of operation (depicted in FIG. 5). A user of the apparatus may then open the lid and apply a further downward force until the apparatus transitions into a lowered configuration of operation (depicted in FIG. 2 and FIG. 6). In this lowered configuration of operation of the apparatus, the upper surface of the upper compression plate is essentially flush with the top opening of the upper body and the compacted block of snow has been effectively ejected from the compression chamber, allowing a user to easily pick it up. The user may then apply an upwardly directed force to the upper box (via the handles (116)) to place the apparatus once again in a raised configuration of operation so that further compactable material may be place within the compression chamber. Thus, one advantage of the apparatus for forming blocks of compactable material described herein is that it can be easily used by both adults and children to rapidly form numerous snow blocks in a very short period of time.

It should be noted that while the upper body, lower body, lid, and base member of the apparatus depicted in the drawings are rectangular in shape, it is contemplated that alternate embodiments of the apparatus may be constructed in various other shapes and combinations of shapes. For example, in one embodiment, the exterior walls of the upper body may be cylindrical in appearance, while the compression chamber, upper compression plate, and elongate lower section of the lower body are rectangular in shape (in such embodiments, the interior walls of the upper body may be formed separately from the exterior walls of the upper body). In another alternate embodiment of the apparatus, the upper body, compression chamber, upper compression plate, and elongate lower section of the lower body may all be substantially cylindrical in shape, such that the apparatus is able to form blocks having a cylindrical shape. In even further alternate embodiments of the apparatus, the structures of the apparatus may have other shapes such that blocks having other types of shapes (hexagonal, octagonal, etc.) may be formed by the apparatus. Likewise, the structures of the apparatus may be constructed of various materials including, for example, wood, metals, alloys, polymers, and combinations of the foregoing materials. In one embodiment, a base member (108) may be attached or fastened to the bottom end of the elongate lower section (114) of the lower body (104) to provide enhanced stability of the overall apparatus when positioned and resting on top of snow covered ground. In one embodiment, the base member (108) is configured to have an outer perimeter that is larger than the outer perimeter of the elongate lower section of the lower body as depicted in FIG. 1. The base member, while depicted to be rectangular in shape in the drawings, may in alternate embodiments be constructed in various other shapes. In alternate embodiments, the base member may include protrusions such as one or more spikes on the underside of the base member, allowing a user to more securely anchor the apparatus into the ground. In other alternate embodiments, the base member may be attached to the elongate lower section via a ball and socket joint that allows the base member to swivel and tilt with respect to the elongate lower section, permitting the base member to rest on an inclined surface (such as a sloped section of ground), while also allowing the elongate lower section to maintain a substantially vertical orientation. In one embodiment, an M-RN-86 Ball and Socket Stage, manufactured by Newton Corporation, may serve as a locking ball and socket joint for attachment between an upper surface of a base member and a bottom end of a elongate lower section of the lower body of the apparatus. Such a locking ball and socket joint would permit the lower body of the apparatus to tilt up to twenty-five degrees in any direction with respect to the base member and be at least temporarily locked in such a position. A clutch lever included on the M-RN-86 Ball and Socket Stage locks and unlocks the rotation of the ball and socket joint. Substantially planar platforms fastened to opposing sides of the M-RN-86 Ball and Socket Stage may in turn each be fastened to the base member and bottom end of the elongate lower section of the apparatus, respectively, thereby securing the ball and socket joint between said base member and said bottom end of said elongate lower section of the apparatus. In even other alternate embodiments, a wider base member may be absent, the apparatus being configured to rest on and be supported by the bottom end of the elongate lower section of the lower body. In such alternate embodiments not having a wider base member attached at a bottom end of the apparatus, the bottom end of the elongate lower section of the lower body may be flat in shape, or may include downwardly protruding bottom edges having a tapered thickness to provide a sharper bottom edge so as to allow said bottom end to be more securely anchored into the snow or sand.

Still referring to FIG. 1, in one embodiment of the apparatus (101) for forming blocks of compactable material, the lid (106) is attached to the top end of the upper hollow body with a hinge (118). The hinge (118), which may in one embodiment be fastened to the lid and upper body using screws (120), provides a user with the ability to open and close the lid to uncover or cover, respectively, the top opening to the compression chamber (113).

Referring now to FIG. 2, an upper perspective view of the embodiment of the apparatus for forming blocks of compactable material as depicted in FIG. 1, shown in a lowered configuration of operation. In FIG. 2, the lid (106) is attached to the upper body with a hinge (118) using screws (120), and is shown in a closed position, covering the top opening of the upper body, and revealing a top surface (126) of the lid. The lid may be placed in an open or closed position by a user in any configuration of operation of the apparatus. In alternate embodiments, the lid may be attached to the upper body by means other than a hinge such as, for example, a rail system attached to the underside of the lid and the top end of the walls of the upper body, allowing the lid to slide laterally into an open or closed position. In other embodiments, the lid may be configured to rest over the top opening of the upper body but not be attached to the upper body, allowing the user to manually remove the lid when not in use, and then manually cover the top opening when necessary to compact snow during operation of the apparatus (although such an embodiment would likely result in a decreased tempo of operation). In even further alternate embodiments of the apparatus, rather than utilizing a separate hinge component to attach the lid to the upper body, hinge elements may be integrally formed on the lid and also on the top end of the upper body (which may be accomplished through, for example, injection molding of such apparatus structures), such integrally formed hinge elements capable of being coupled together with the use of a hinge pin.

Figure 3:
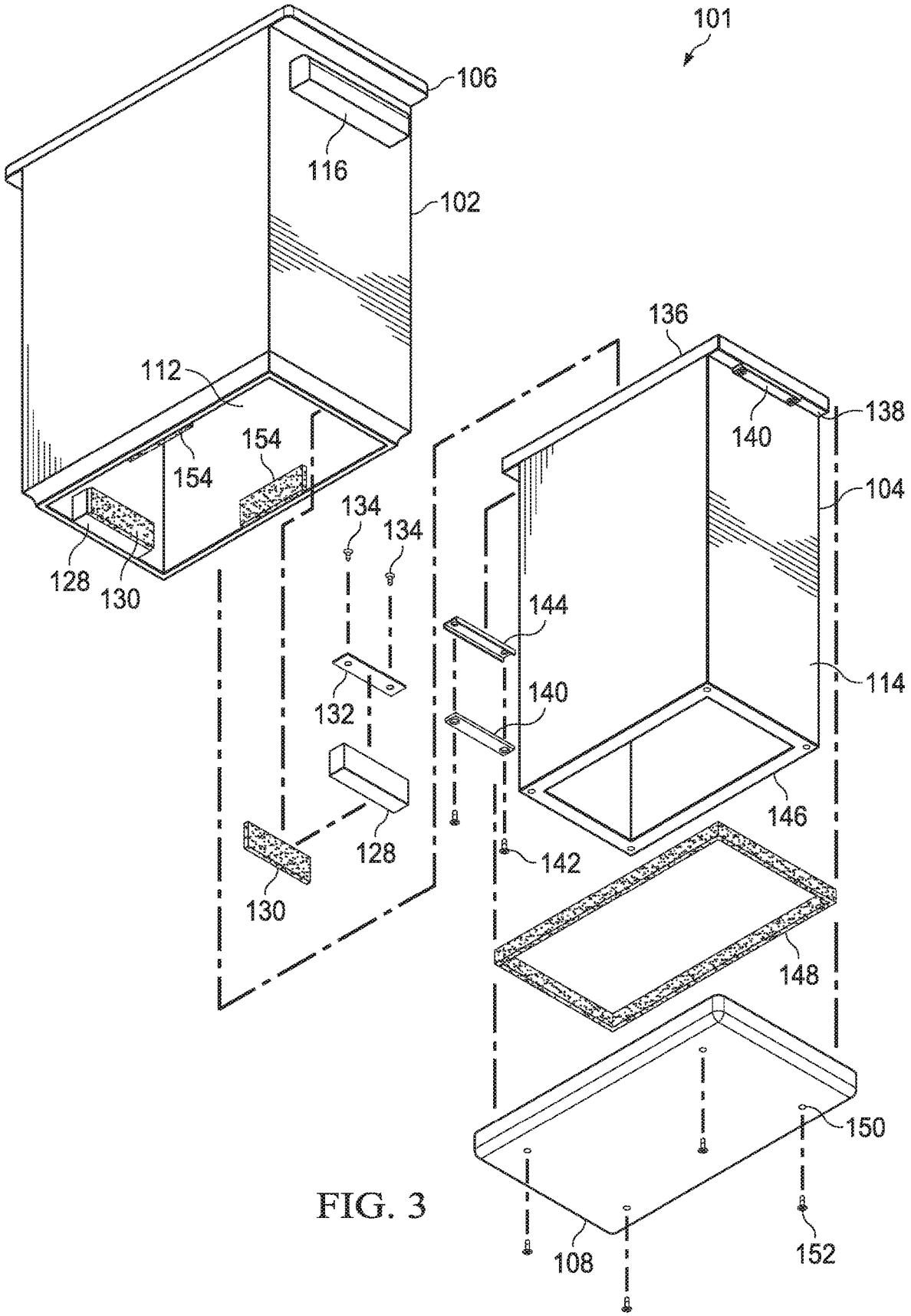
FIG. 3 is an exploded view of the embodiment of the apparatus for forming blocks of compactable material as depicted in FIG. 1 and FIG. 2.

Referring now to FIG. 3, an exploded view of the embodiment of the apparatus for forming blocks of compactable material as depicted in FIG. 1 and FIG. 2 is shown. In one embodiment of the apparatus (101), one or more elongate shelves (128) may be attached (via fasteners, adhesives, welding, etc.) to, or formed on, the interior walls (112) of the hollow upper body (102). In one embodiment of the apparatus, as depicted in FIG. 3, the shelves are elongate and rectangular in shape (appearing like a block), and are attached to opposing sides of the interior walls (112) adjacent to the bottom opening of the upper body. In alternate embodiments, the shelves may have various other shapes and sizes, there may be more or less shelves attached to, or formed on, the interior walls of the upper body, and such shelves may be attached to, or formed on, the interior walls of the upper body at locations closer to the top opening of the upper body. The placement of the shelves on the interior walls and in particular, the distance between the shelf(ves) and the top opening of the upper body, will determine the available maximum volume of the compression chamber of the apparatus. In one embodiment, the shelf(ves) form part of the interior walls and are not separate components of the apparatus apart from the interior walls. A shelf may also be referred to herein as a "ledge" or any other term referring to a structure protruding from the interior walls of the upper body and having a substantially flat upper surface on which an upwardly facing releasable fastener (such as a ferromagnetic material or clip) may be formed or attached.

Still referring to FIG. 3, in one embodiment, an upwardly facing ferromagnetic material (132) (such as a permanent magnet or a metal or combination of metals that is attracted to a magnet) is attached to the upper surface of each shelf, with each shelf in turn being attached to or formed on the interior walls of the upper body as described above. Examples of metals that are attracted to a magnet include steel and iron. In one embodiment, the upwardly facing ferromagnetic materials are fastened to each shelf via screws that are configured to fit through holes in such ferromagnetic materials and shelves, thereby securing the ferromagnetic materials to the upper surface of each shelf. In one embodiment, a gasket (130) is attached to the inner surface (surface facing opposite of interior wall to which shelf is attached) of each of the shelves (128), and a gasket (154) is also attached to each of the interior walls to which a shelf is not attached. The gaskets (130, 148) described herein can have varying thicknesses in various alternate embodiments of the apparatus, depending on the type of material used to serve as a gasket, and also depending on the relative sizes of the outer perimeter of the upper compression plate and inner perimeter of the interior walls of the upper body, respectively. In one embodiment, the gasket is constructed of a thin strip (having a thickness of ~2 mm-10 mm) of felt material having a rectangular shape, although gaskets of various thicknesses may be utilized in other alternate embodiments. The gaskets are configured to come into contact with the exterior walls of the elongate lower section (114) as such elongate lower section slides within the upper body as the apparatus transitions between raised, intermediate, and lowered configurations of operation (or as the upper body slides up and down around the lower body, depending on perspective). The gaskets (130, 154) decrease the friction between the upper body and the elongate lower section of the lower body during such transitions (when the lower body is sliding within the upper body). In one embodiment, a gasket (148) is configured to be lined around the outer perimeter of the compression plate (136). The gasket (148), which is in one embodiment constructed of a felt material having a thickness of ~2 mm-10 mm, is configured to be in contact with the interior walls of the upper body. The gasket (148) configured to be lined around the outer perimeter of the upper compression plate may in one embodiment have a thickness that is the same or approximately the same as the thickness of the gasket(s) (130, 154) attached to the shelves and interior walls, but in other embodiments, each of the gaskets may have different thicknesses. In other words, the gasket (148) is configured to be positioned between a gap formed between the outer perimeter of the compression plate and an inner perimeter of the interior walls of the upper body. As such, while the outer perimeter of the compression plate is substantially equivalent to the inner perimeter of the interior walls of the upper body, it is contemplated that a gasket (148) is placed between such upper compression plate outer perimeter and such inner perimeter of the interior walls. Accordingly, when reference is made herein that the outer perimeter of the upper compression plate is substantially equivalent or equal to the inner perimeter of the interior walls of the upper body, it is intended to mean that the outer perimeter of the upper compression plate is only slightly smaller than the inner perimeter of the interior walls of the upper body, with the gasket (148) surrounding and attached to the upper compression plate (for example, using an adhesive) filling in any lateral gap between the structures. The gasket (148) works to decrease the friction between the upper compression plate and the interior walls of the compression chamber as the apparatus transitions between raised, intermediate, and lowered configurations of operation. The gasket also works as a seal between the outer perimeter of the compression plate and the inner perimeter of the interior walls. The gasket (148) being attached to the outer perimeter of the upper compression plate (136), the gasket travels with the upper compression plate up and down the length of the compression chamber as the apparatus travels from raised, intermediate, and lowered configurations of operation. While the gaskets depicted in the drawings provided herein are constructed of a felt material, alternate embodiments of the apparatus may utilize other materials as a gasket to decrease frictional resistance and to provide a seal between the structures of the apparatus, including various natural and synthetic rubbers, silicone, neoprene rubber, polytetrafluoroethylene (PTFE), and various polymers.

Still referring to FIG. 3, the outer perimeter of the upper compression plate (136) is larger than an outer perimeter of the elongate lower section of the lower body (104), resulting in an overhanging section (138) on opposing ends of the upper compression plate. As used herein, the term "outer perimeter" when used in reference to the upper compression plate means the distance around the lateral edges of the upper compression plate. Downwardly facing ferromagnetic materials (140) (such as a permanent magnet or a metal or combination of metals that is attracted to a magnet) are attached to the undersides of the overhanging sections (138) of the upper compression plate. In one embodiment, the downwardly facing ferromagnetic materials are fastened to each side of the overhanging sections of the upper compression plate via screws (142) that are configured to fit through holes in such ferromagnetic materials and compression plate, thereby securing the ferromagnetic materials to the underside of the respective overhanging sections of the compression plate. In one embodiment, a retaining bracket (144) may be utilized to further secure the ferromagnetic materials to the compression plate. It should be noted that while the ferromagnetic materials are depicted in FIG. 3 as being attached to the apparatus via fasteners (screws), it is contemplated that all or a portion of the ferromagnetic materials (for example, permanent magnets and/or combinations of permanent magnets and steel or other ferromagnetic metals/alloys) utilized in alternate embodiments of the apparatus may be attached to the apparatus via other means such as, for example, through the use of adhesive substances or welding. It should be noted that the term "ferromagnetic materials" is intended to also encompass ferrimagnetic materials. In other alternate embodiments, the shelves, upper compression plate, or upper body themselves may be constructed of a ferromagnetic material that itself provides the magnetic attractive forces utilized by this invention. By way of example, in an alternate embodiment, the compression plate may be constructed of a ferromagnetic material such stainless steel. Permanent magnets attached to the upper surface of shelves would come into contact with the stainless steel overhanging section of the compression plate when the alternate embodiment of the apparatus is placed in a raised configuration of operation (as depicted in FIG. 4), providing a magnetic attractive force between the steel and the magnets, which works to at least temporarily halt the sliding movement of the upper body with respect to the lower body (and compression plate), allowing a user to fill the compression chamber with compactable material such as snow.

Referring to now FIG. 4, a cross-sectional view of the embodiment of the apparatus (101) for forming blocks of compactable material as depicted in FIG. 1 in a raised configuration of operation is shown. In the raised configuration of operation of the apparatus depicted in FIG. 4, compactable material (401) such as snow has been placed into the compression chamber of the upper body (102) of the apparatus by a user (for example, with a shovel). In this raised configuration of operation, the downwardly facing ferromagnetic materials (140) attached to the underside of the overhanging section of the compression plate (136) are in direct contact with the upwardly facing ferromagnetic materials (132) attached to the upper surfaces of the shelves (128), that are in turn attached to the interior walls of the upper body (102). A magnetic attraction between the downwardly facing ferromagnetic materials and the upwardly facing second ferromagnetic materials in a raised configuration of operation of the apparatus acts to at least temporarily arrest any sliding action of the upper compression plate within the compression chamber. In other words, such magnetic attraction at least temporarily maintains the apparatus in the raised configuration of operation, preventing the downward force of gravity acting on the upper body from transitioning the apparatus into an intermediate or lowered configuration of operation. This provides an advantage in that as the user is shoveling the compactable material into the compression chamber (with the lid in an open position), with both hands grasping a shovel, the compression chamber is maintained at its maximum available volume, allowing the user to fill up the compression chamber with snow without it being necessary for a third party to hold the apparatus in a raised configuration of operation. While the apparatus depicted herein is shown to include two pairs of upwardly facing and downwardly facing ferromagnetic materials (132, 140), it is contemplated that alternate embodiments may utilize fewer (one pair) or more pairs (more than two pairs) of opposing ferromagnetic materials (or other types of releasable fasteners) to arrest the sliding action of the apparatus. The numbers and types of ferromagnetic materials, having stronger or weaker magnetic attractive forces, may be selected depending on factors such as, for example, the weight of the upper body of the apparatus (a heavier upper body may require the use of more and/or stronger ferromagnetic materials) and/or the ability of the user to overcome such attractive forces generated between the opposing ferromagnetic materials (an apparatus designed for use by children may utilize fewer or weaker ferromagnetic materials).

Figure 5:
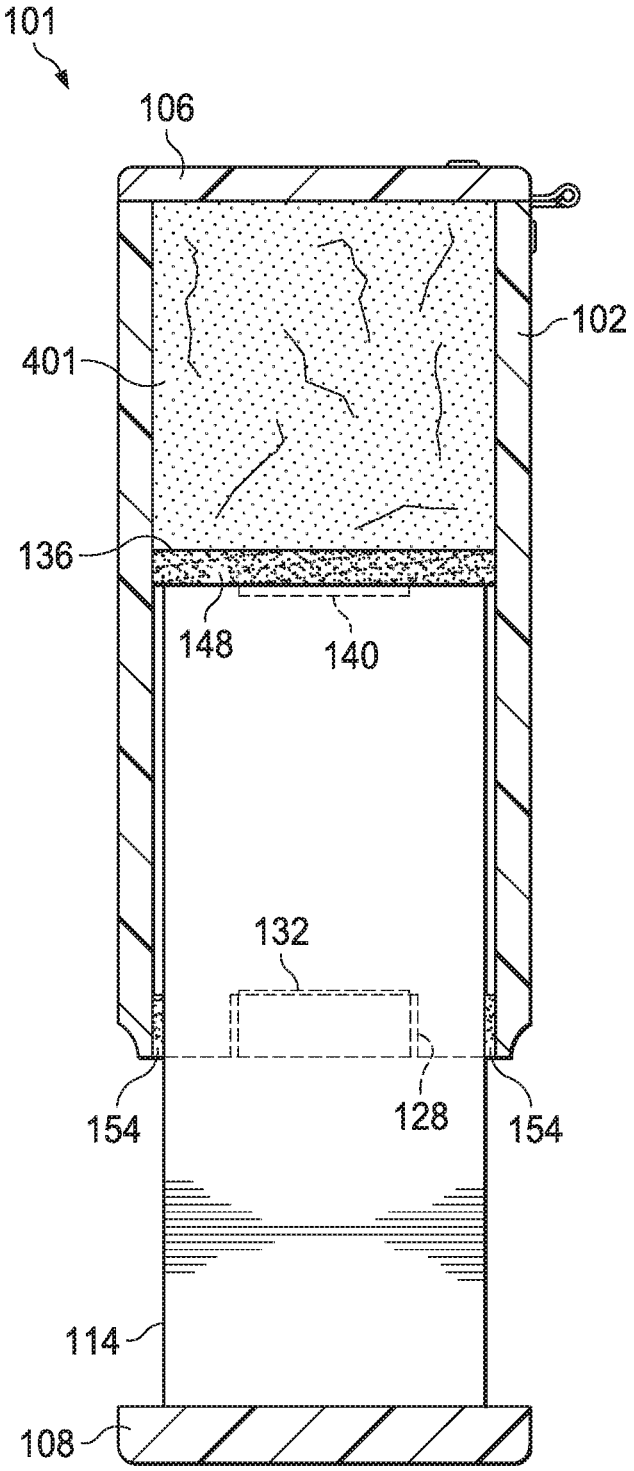
FIG. 5 is a cross-sectional view of the embodiment of the apparatus for forming blocks of compactable material as depicted in FIG. 1, shown in an intermediate configuration of operation, and having compactable material contained within the compression chamber.

Referring now to FIG. 5, a cross-sectional view of the embodiment of the apparatus for forming blocks of compactable material as depicted in FIG. 1, in an intermediate configuration of operation, is shown. In this intermediate configuration of operation depicted in FIG. 5, the downwardly facing ferromagnetic material (140) is no longer in direct contact with the upwardly facing ferromagnetic material (132), resulting in much weaker and practically negligible magnetic attractive forces from the perspective of a user. When in the raised configuration of operation, a user may apply a downwardly directed force on the upper body (applied to the lid or to the handles) necessary to overcome the magnetic attractive forces existing between the downwardly facing ferromagnetic materials and the upwardly facing ferromagnetic materials. Such downwardly directed force applied by the user on the upper body will also overcome the frictional forces between the compression plate and the interior walls of the upper body, which are intended to be reduced by the gasket (148) lining and attached to the outer perimeter of the upper compression plate, said gasket sliding against the interior walls of the compression chamber. As the compression plate slides in the direction of the top opening of the upper body, the compactable material is compressed against the closed lid, making such compactable material (401) more dense and forming the compactable material into a more structurally rigid block or brick shaped form. It should be noted that the elongate lower section (114) of the lower body has an outer perimeter of exterior walls that permits such elongate lower section to be inserted into the hollow upper body.

Figure 6:
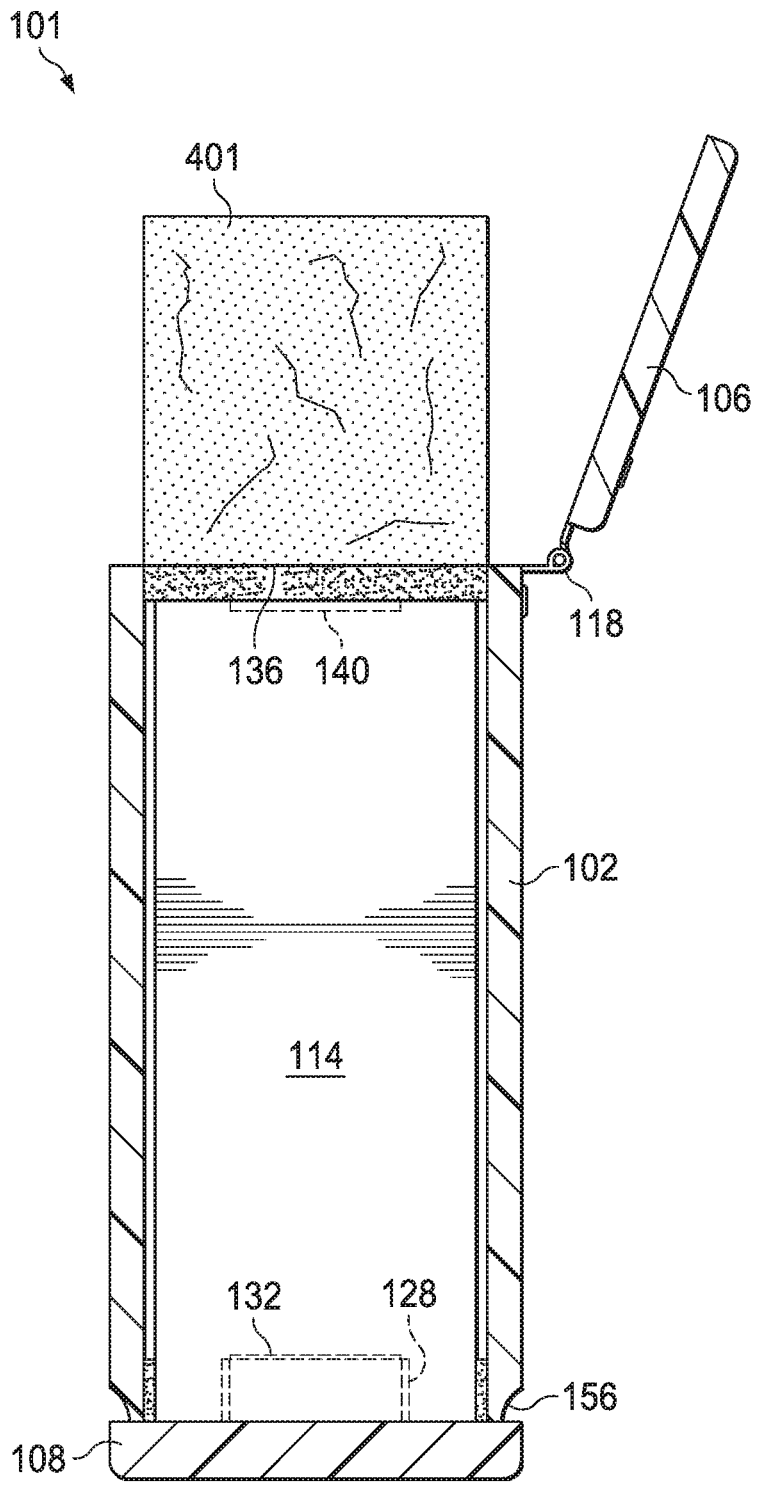
FIG. 6 is a cross-sectional view of the embodiment of the apparatus for forming blocks of compactable material as depicted in FIG. 1, shown in a lowered configuration of operation with compactable material ejected from the compression chamber.
Figure 7:
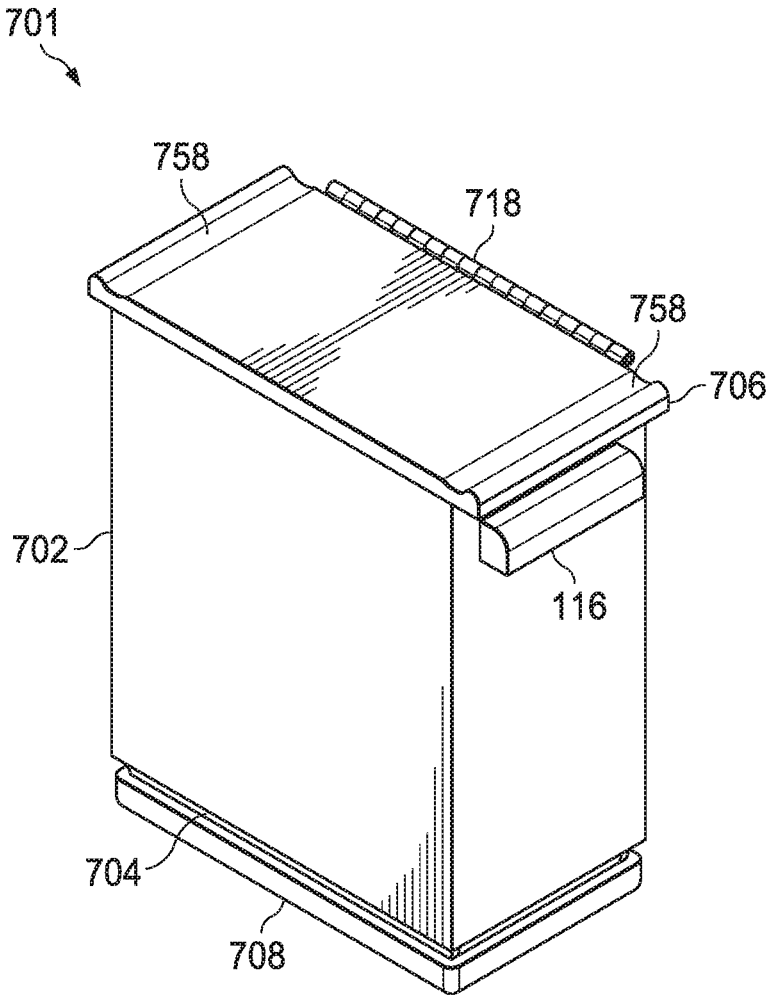
FIG. 7 is an upper perspective view of an alternate embodiment of an apparatus for forming blocks of compactable material shown in a lowered configuration of operation.

Referring now to FIG. 6, a cross-sectional view of the embodiment of the apparatus for forming blocks of compactable material as depicted in FIG. 1, shown in a lowered configuration of operation. In this lowered configuration of operation, the upper surface of the upper compression plate (136) is substantially flush with the top opening of the upper body (102), the lid having been placed by the user in an open position to allow for the ejection of a compacted block of compactable material from the compression chamber. A user may easily remove the block of compactable material once ejected from the compression chamber.

Still referring to FIG. 6, in one embodiment of the apparatus, the center of the hinge (118) connecting the lid (106) to the top end of the upper body (102) is extended outward from the exterior walls of said upper body. In one embodiment, the center of the hinge (pin forming an axis of rotation of the hinge) extends approximately one inch from the adjacent exterior wall of the upper body, although the length of such an extension may vary in alternate embodiments. While not shown, this extension of the hinge permits the lid to swing away from the top opening of the upper body and to hang substantially vertical in a downward position or flat against the back side of the exterior wall of the upper body. In such a vertical downward position, the top opening of the upper body is fully accessible to a user that desires to easily fill the compression chamber with compactable material. In one embodiment, a thickness of the bottom end of exterior walls of said hollow upper body is tapered (156). In an embodiment of the apparatus in which the lower base member (108) is removed, or the apparatus does not include such lower base member, the tapered bottom end of the exterior walls of the upper body works to reduce the accumulation of snow under the apparatus, and also works to allow the sharpened bottom end to more easily cut through the snow to provide a more stable anchor for the apparatus. Another advantage of utilizing tapered bottom ends (156) of the exterior walls of the upper body is that such tapered bottom ends can cut through packed accumulated snow to increase the likelihood that the apparatus can achieve a fully lowered configuration of operation. Achieving a fully lowered configuration of operation is important to the overall function of the apparatus because it allows the upper surface of the upper compression plate to be essentially flush with the top opening to the upper body, making ejection and removal of the compacted snow block much more seamless. In the case of accumulated snow preventing the apparatus from achieving a fully lowered configuration of operation, the edge of the top opening of the upper body would be raised in relation to the upper surface of the upper compression plate, making it much more difficult for a user to remove the snow block formed by the apparatus. In one embodiment in which the apparatus is constructed of wood, the aforementioned tapered bottom end may be constructed by using a router around said bottom end of the upper body. In other embodiments of the apparatus constructed of alternate materials, the tapered bottom ends described herein may be formed using other manufacturing techniques known in the art.

Referring now to FIG. 7, an upper perspective view of an alternate embodiment of an apparatus (701) for forming blocks of compactable material in a lowered configuration of operation is shown. Two elongated rounded indentations (758) are formed on a top surface of said lid. The elongated rounded indentations in one embodiment have a length of at least three inches and a width of at least one inch, although such dimensions of the indentations may vary in other alternate embodiments of the apparatus. In this alternate embodiment, the opposing ends of the lid adjacent to the aforementioned indentations are raised and rounded. The indentations and raised/rounded portions of the lid serve as structures on which a user may more easily grasp to apply a downwardly directed force to overcome the magnetic attractive forces as necessary to transition the apparatus from a raised configuration of operation to an intermediate or lowered configuration of operation. The handles (116) attached to or formed on the exterior walls of the upper body may be used to apply upwardly or downwardly directed forces on the upper body. It should be noted that such handles may be constructed in various shapes and sizes. In other embodiments of the apparatus, the lid and/or handles may include outer surfaces that are textured to increase the ability of a user to maintain a grasp on such structures and to prevent slippage.

Figure 8:
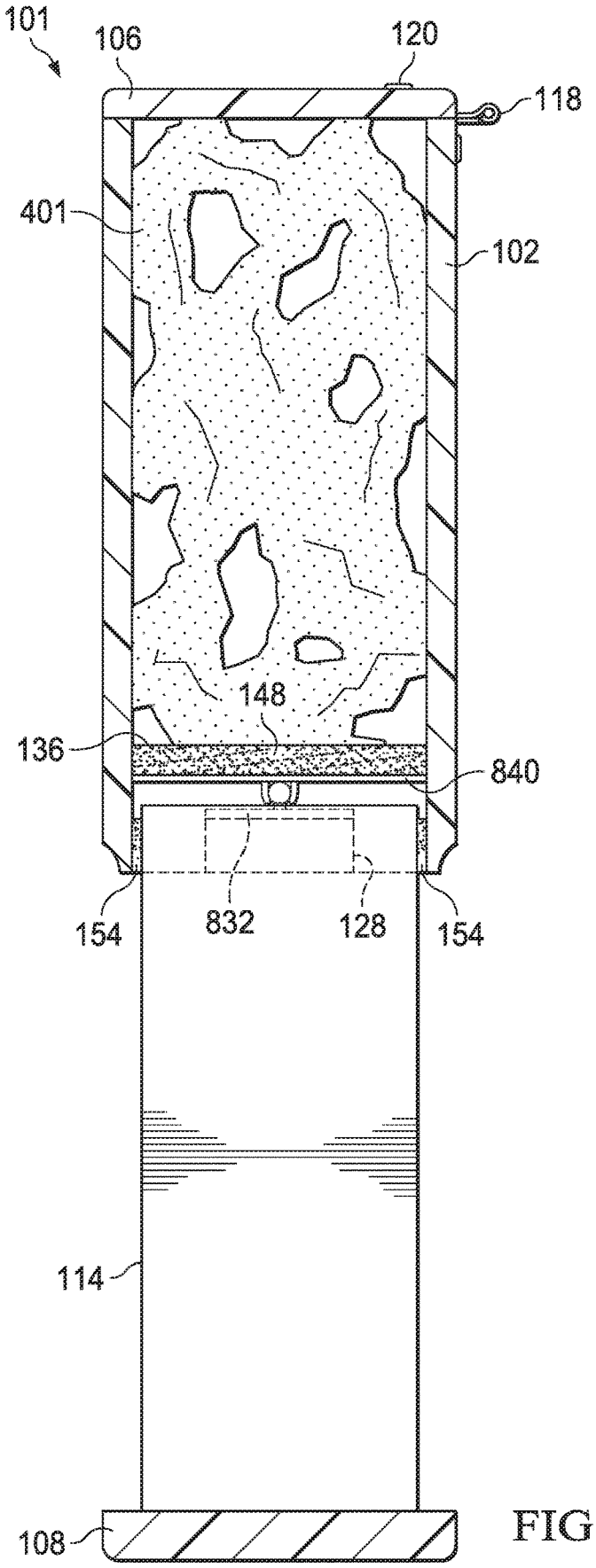
FIG. 8 is a cross-sectional view of an alternate embodiment of the apparatus for forming blocks of compactable material, shown in a raised configuration of operation, and having compactable material contained within the compression chamber.

Referring now to FIG. 8, a cross-sectional view of an alternate embodiment of the apparatus for forming blocks of compactable material is shown in a raised configuration of operation. In this alternate embodiment of the apparatus, one or more alternate types of releasable fasteners are utilized to at least temporarily maintain the apparatus in a raised configuration of operation as depicted in FIG. 8. In the embodiments of the apparatus for forming blocks of compactable material described above, releasable fasteners constructed of ferromagnetic materials have been described. However, in the embodiment depicted in FIG. 8, the releasable fasteners utilized to maintain the apparatus at least temporarily in a raised configuration of operation comprise ball and socket type clips. The use of the one or more ball and socket type clips, shown mated to one another in this alternate embodiment of the apparatus, provides an example of an alternate means (an alternative to the ferromagnetic materials described above) for maintaining the apparatus in a raised configuration of operation. Rather than providing a pivoting attachment, the ball and socket clip in this embodiment are configured to repeatedly couple and decouple from one another, and when coupled, maintain a mechanical coupling force with one another until such time as a user applies a downward force on the upper body to mechanically decouple the ball from the socket.

Still referring to FIG. 8, the ball portion (832) of the clip comprises in one embodiment a ball having a substantially spherical shape that is formed or attached to the top of a rectangular base member. The rectangular base member of the ball portion (lower part of releasable fastener) of the clip (832) is attached or formed on a top surface of a block-shaped shelf (128) protruding from a side of said interior walls and into said compression chamber of said hollow upper body (102). The socket portion (840) (upper part of releasable fastener) of the clip comprises in one embodiment a socket having a female clasp shaped to mate with the ball portion of the clip, said socket being downwardly facing and formed or attached to the bottom of a rectangular base member. The rectangular base member of the socket portion of the clip (840) is attached or formed on an underside surface of an overhanging section of the upper compression plate (136). In one embodiment, the ball and socket type clip is constructed of a polymer having sufficient rigidity to maintain a connection between the ball and socket when mated, yet having enough flexibility to allow a user to couple and decouple the ball and socket to and from one another without inordinate difficulty. In some embodiments, the ball is constructed of a relatively rigid polymer (for example Nylon), while the socket is constructed of a polymer that is somewhat more flexible and resilient (for example, Santoprene). The ball and socket in this manner may be snapped together and apart along the mating lines between the ball and socket. When coupling and decoupling the ball and socket, the walls of the socket are resiliently deformed by the mechanical forces pushing or pulling the ball and socket together or apart, respectively. In some embodiments, only a single ball and socket type clip will need to be utilized to maintain the apparatus in a raised configuration of operation. In other embodiments, multiple ball and socket clips may be utilized (for example, by attaching such clips to the opposite side of the apparatus on a shelf and overhanging section of the upper compression plate).

Figure 9:
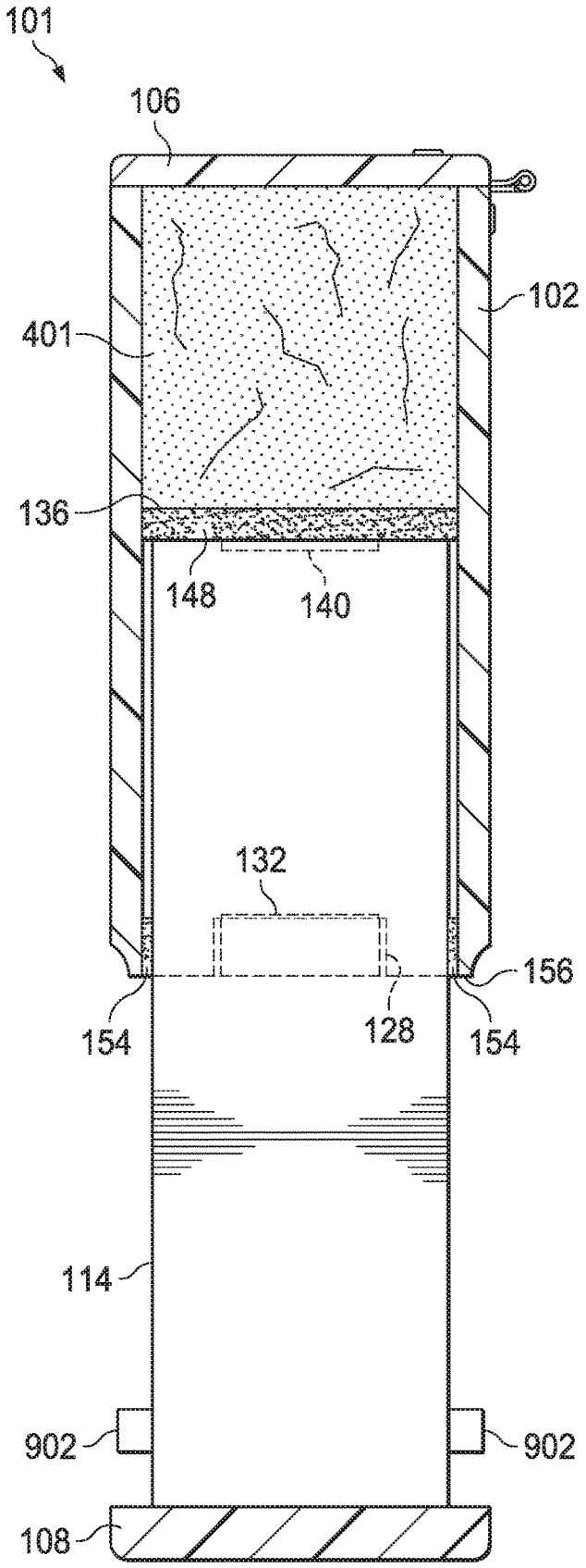
FIG. 9 is a cross-sectional view of an alternate embodiment of the apparatus for forming blocks of compactable material shown in an intermediate configuration of operation.

Referring now to FIG. 9, a cross-sectional view of an alternate embodiment of the apparatus for forming blocks of compactable material is shown in an intermediate configuration of operation. In the embodiments of the apparatus described above, the elongate lower section of the lower body has a length that is roughly equivalent to the length of the compression chamber. However, in the alternate embodiment depicted in FIG. 9, the elongate lower section (114) has a length greater than the length of the compression chamber, and has cube shaped pegs (902) attached to the exterior walls of such elongate lower section (114). In this alternate embodiment, the upper body may be lowered until the bottom end (156) contacts the pegs (902), thereby halting and further lowering of the upper body with respect to the elongate lower section. By utilizing a lengthier elongate lower section of the lower body in this manner, the top end of upper body is positioned higher when the apparatus is placed in a lowered configuration of operation, thus making it easier for a user to remove an ejected block of compactable material (ideally reducing the occurrence of back pain when using the apparatus for extended periods of time). The pegs (902), which in alternate embodiments may comprise any other types of laterally extending bodies other than pegs, are positioned on the walls of the elongate lower section (114) of the lower body such that at the point at which the bottom end (156) contacts such pegs, any further lower movement of the upper body is halted, and the top surface of the upper compression plate is essentially flush with the top opening of the upper body such as is depicted in FIG. 6. It is contemplated that the distance between the pegs (902) and base member (108) may vary considerably in alternate embodiments of the apparatus, depending on the desired height of the apparatus when in a raised and lowered configuration of operation.

In one embodiment, disclosed herein is an apparatus (101) for forming blocks of compactable material (401), the apparatus comprising a hollow upper body (102) having interior walls (112) forming a compression chamber (113) for filling with compactable material (401), the compression chamber (113) has a top opening and a bottom opening; a lid (106) that is attached to the hollow upper body such that when the lid is in a closed position, the lid covers the top opening of the compression chamber; and a lower body having a flat upper compression plate (136) that is formed on a top end of an elongate lower section (114) and is configured to nest within the compression chamber, the upper compression plate having an outer perimeter that is substantially equal to an inside perimeter of the interior walls of the compression chamber such that the upper compression plate is sized to slide within at least a portion of a length of the compression chamber. In one embodiment, the apparatus also includes at least one downwardly facing upper part of a releasable fastener (840) is attached to an underside surface of said upper compression plate. In one embodiment, the apparatus also includes at least one upwardly facing lower part (832) of the releasable fastener that is attached to a shelf (128) protruding from a side of the interior walls and into said compression chamber of the hollow upper body, such that when the apparatus is in a raised configuration of operation as depicted in FIG. 8, the downwardly facing upper part of the releasable fastener directly contacts said at least one upwardly facing lower part of said releasable fastener to at least temporarily arrest any sliding of said upper compression plate within said compression chamber.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes that come within the meaning and range of equivalency of the claims are embraced therein. Further, the recitation of method steps does not denote a particular sequence for execution of the steps. Such method steps may therefore be performed in a sequence other than that recited unless the particular claim expressly states otherwise.

I claim:

1. An apparatus for forming blocks of compactable material, said apparatus comprising:

a hollow upper body having interior walls forming a compression chamber for filling with compactable material, said hollow upper body having a front exterior wall, back exterior wall, two lateral exterior walls, said compression chamber having a top opening and a bottom opening;

a lid that is attached to said hollow upper body such that when said lid is in a closed position, said lid covers said top opening of said compression chamber; and a lower body having a flat upper compression plate that is formed on a top end of an elongate lower section of the lower body and is configured to nest within said compression chamber, said upper compression plate having an outer perimeter that is substantially equal to an inside perimeter of said interior walls of said compression chamber, said upper compression plate and at least a portion of said elongate lower section both being sized to slide within at least a portion of a length of said compression chamber, wherein at least one downwardly facing first ferromagnetic material is attached to an underside surface of a section of said upper compression plate;

wherein at least one upwardly facing second ferromagnetic material is attached to a shelf protruding from a side of said interior walls of the hollow upper body and into said compression chamber of said hollow upper body, such that when said apparatus is in a raised configuration of operation, said at least one downwardly facing first ferromagnetic material directly contacts said at least one upwardly facing second ferromagnetic material to arrest any sliding of said upper compression plate within said compression chamber, wherein two elongated indentations are formed on a top surface of said lid, one of each of said two elongated indentations being formed adjacent to opposing lateral ends of said top surface of said lid, and each of said two elongated indentations having a length of at least three inches and a width of at least one inch.

2. The apparatus for forming blocks of compactable material of claim 1, wherein a handle is formed on each of said two lateral exterior walls of said hollow upper body.

3. The apparatus for forming blocks of compactable material of claim 1, wherein said outer perimeter of said upper compression plate is larger than a second outer perimeter of said lower elongate section of said lower body.

4. The apparatus for forming blocks of compactable material of claim 3, wherein at least the section of said upper compression plate overhangs said elongate lower section.

5. The apparatus for forming blocks of compactable material of claim 1, wherein one or more pegs are each positioned on an exterior side of a lower portion of said elongate lower section of said lower body, said one or more pegs being positioned to contact a bottom end of said upper body when said apparatus is in a lowered configuration of operation.

6. The apparatus for forming blocks of compactable material of claim 1, wherein said at least one downwardly facing first ferromagnetic material comprises a permanent magnet.

7. The apparatus for forming blocks of compactable material of claim 1, wherein said at least one upwardly facing first ferromagnetic material comprises a permanent magnet.

8. The apparatus for forming blocks of compactable material of claim 1, wherein at least a portion of said outer perimeter of said upper compression plate is lined with a gasket.

9. The apparatus for forming blocks of compactable material of claim 1, wherein at least a portion of said interior walls of said hollow upper body is lined with a gasket.

10. The apparatus for forming blocks of compactable material of claim 1, wherein said lid is hingedly attached to an upper end of said hollow upper body.

11. The apparatus for forming blocks of compactable material of claim 3, further comprising a base member attached to a bottom end of said elongate lower section of said lower body, said base member being wider than said elongate lower section of said lower body.

12. The apparatus for forming blocks of compactable material of claim 1, wherein a thickness of a bottom end of the exterior walls of said hollow upper body is tapered.

13. The apparatus for forming blocks of compactable material of claim 1, wherein said hollow upper body and said lower body are constructed of wood.

14. The apparatus for forming blocks of compactable material of claim 1, wherein said hollow upper body and said lower body are constructed of a polymer material.

15. The apparatus for forming blocks of compactable material of claim 11, wherein said base member and said elongate lower section of said lower body are attached to another via a ball and socket joint.

16. An apparatus for forming blocks of compactable material, said apparatus comprising:

a hollow upper body having interior walls forming a compression chamber for filling with compactable material, said hollow upper body having a front exterior wall, back exterior wall, two lateral exterior walls, said compression chamber having a top opening and a bottom opening;

a lid that is attached to said hollow upper body such that when said lid is in a closed position, said lid covers said top opening of said compression chamber; and a lower body having a flat upper compression plate that is formed on a top end of an elongate lower section of the lower body and is configured to nest within said compression chamber, said upper compression plate having an outer perimeter that is substantially equal to an inside perimeter of said interior walls of said compression chamber such that said upper compression plate is sized to slide within at least a portion of a length of said compression chamber, wherein at least one downwardly facing upper part of a releasable fastener is attached to an underside surface of a section of said upper compression plate;

wherein at least one upwardly facing lower part of said releasable fastener is attached to a shelf protruding from a side of said interior walls of the hollow upper body and into said compression chamber of said hollow upper body, such that when said apparatus is in a raised configuration of operation, said at least one downwardly facing upper part of said releasable fastener directly contacts said at least one upwardly facing lower part of said releasable fastener to arrest any sliding of said upper compression plate within said compression chamber, wherein two elongated indentations are formed on a top surface of said lid, one of each of said two elongated indentations being formed adjacent to opposing lateral ends of said top surface of said lid, and each of said two elongated indentations having a length of at least three inches and a width of at least one inch, wherein a handle is formed on each of said two lateral exterior walls of said hollow upper body.

17. The apparatus for forming blocks of compactable material of claim 16, wherein said releasable fastener comprises a ball and socket clip.

18. The apparatus for forming blocks of compactable material of claim 16, further comprising a base member attached to a bottom end of said elongate lower section of said lower body, said base member being wider than said bottom end of said elongate lower section of said lower body.

19. The apparatus for forming blocks of compactable material of claim 16, wherein one or more pegs are each positioned on an exterior side of a lower portion of said elongate lower section of said lower body, said one or more pegs each being positioned to contact a bottom end of said upper body when said apparatus is in a lowered configuration of operation.

* * * * *